United States Patent [19]

Dean

[11] 4,379,555

[45] Apr. 12, 1983

[54] PUZZLE-GAME

[76] Inventor: Carl J. Dean, RFD, Southbridge, Mass. 01550

[21] Appl. No.: 188,927

[22] Filed: Sep. 19, 1980

[51] Int. Cl.[3] ..... A63F 3/00

[52] U.S. Cl. ..... 273/236

[58] Field of Search ..... 273/236, 242, 243, 270, 273/271

[56] References Cited

U.S. PATENT DOCUMENTS

| | | | |
|---|---|---|---|
| 2,791,430 | 5/1957 | King | 273/236 |
| 3,462,154 | 8/1969 | Giraud | 273/236 |
| 4,093,236 | 6/1978 | Hoffa | 273/262 |

FOREIGN PATENT DOCUMENTS

| | | | |
|---|---|---|---|
| 21745 | of 1904 | United Kingdom | 273/236 |

OTHER PUBLICATIONS

"A Right Fruit Case"; p. 35 *Games and Puzzles*; Summer 1981, No. 81.

*Primary Examiner*—Richard J. Apley
*Attorney, Agent, or Firm*—Joseph S. Iandiorio

[57] ABSTRACT

A puzzle-game having a single playing surface divided into a number of rows, each row containing several divisions, the game including a set of playing elements having distinguishing indicia and "hints" or cues thereon. The object of the game is to arrange the playing elements on the divisions of the playing surface in predetermined patterns which are unknown to the players.

1 Claim, 12 Drawing Figures

PUZZLE-GAME

BACKGROUND OF THE INVENTION

There are many board games which include tiles with indicia thereon, etc., and there are also intellectual puzzles which are not applied to game boards but which state a series of facts from which the player is supposed to determine the answer to the puzzle, as for instance, the relative seating of a number of persons around a table or the time of arrival of a train at a predetermined point, and other factors. It is the object of the present game to combine the best features of games using boards and tiles and the intellectual puzzles aforesaid, these being combined in a novel manner to provide a game which justifiably may be called a puzzlegame.

SUMMARY OF THE INVENTION

The game of the present invention may be used by one or more players of all ages for amusement and educational purposes and the individual parts of the game may be varied to make it more or less complex. In playing this game, it is believed that the game participants will develop reasoning powers and ability to use logic and deduction.

A single player or more than one opposing players work towards filling a single game board with indicia bearing tiles to form a predetermined solution pattern unknown to them, solving the puzzle at least in part by decks of cue cards containing hints. Individual hints on the cue cards will indicate the locations of, e.g., categories, elements, or pluralities thereof, resulting in the formation of mixed groupings, said groupings when combined providing the total predetermined solution.

The feature of the cue card design is that clues or hints are provided in verbal or alpha-numeric form, as well as in graphic representations of the game board with notations to hint at the locations on the actual board of the elements contained in the verbal clue on the cue cards. The players have to reason out the meanings of the hints to determine the correct location of a tile.

The total deck of cue cards is required to achieve the solution but players may draw or exchange cue cards alternately and may not share their known clues except under certain rules. Also a limited amount of chips or means for score keeping and for conducting transactions can be used.

A board which may be made from chip board, paper, plastic, or any suitable material or which may be represented through electronic or other means is divided into rows which are in turn divided into squares or other configurations.

A plurality of tiles are provided, these tiles being adapted to be placed on the game board in a certain predetermined order according to certain predetermined categories. As an example, the tiles may have a certain number imprinted with professions or trades; another set of tiles may be imprinted with different colors; another set may have recreations, means of transportation or pets; and the object of the game is to determine what colors, recreations, transportation or pets go with each one of the aforesaid professions or trades.

In order to determine this, there is a set of cue cards each of which is provided with hints and in the example stated above, such hints may be "lawyer lives in the northeast house; horse owner drives a coupe; engineer lives between the jogger and the golfer". These cue cards may also bear representations of the game board itself and if the player is adept this will assist him in locating his tiles in correct position on the board.

PREFERRED EMBODIMENT OF THE INVENTION

Figure 1:
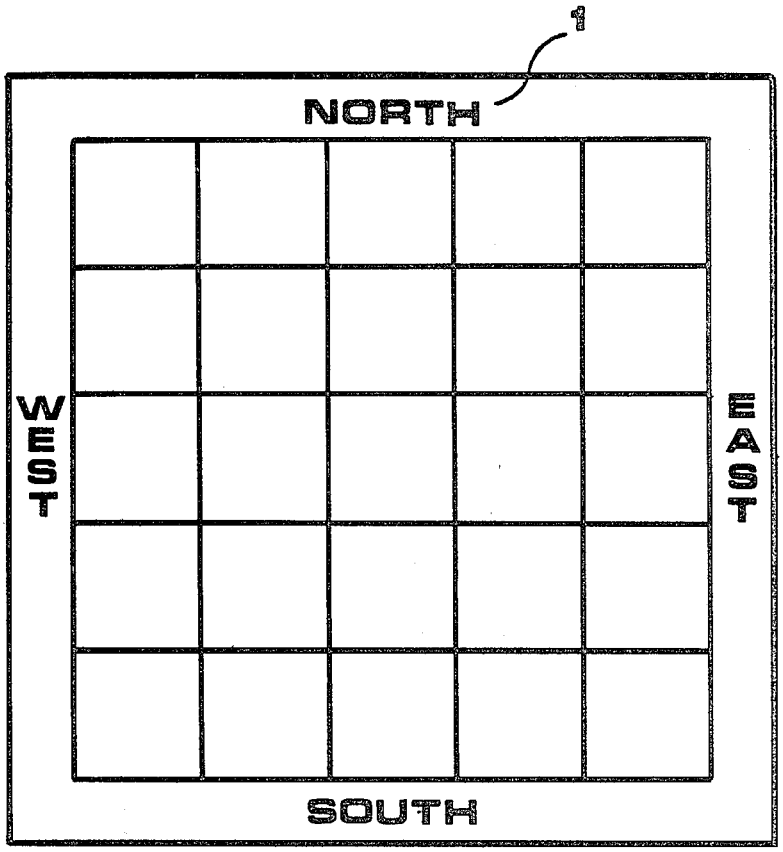
FIG. 1 shows a proposed game board.
Figure 2:
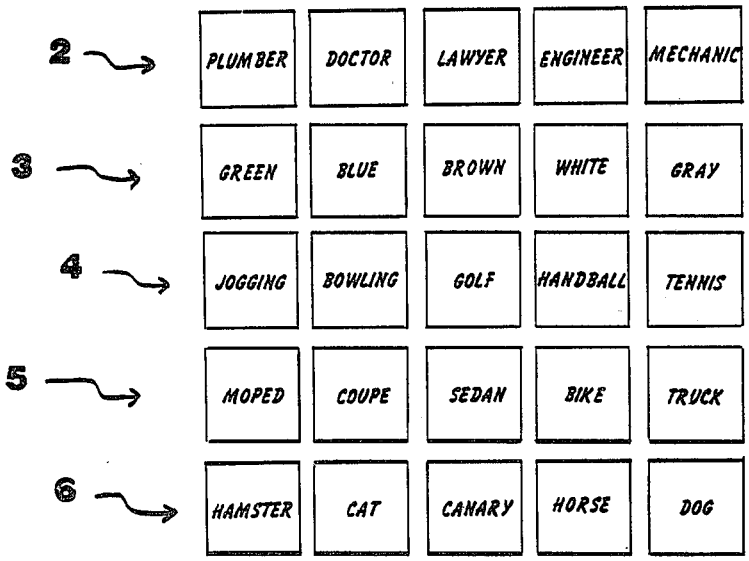
FIG. 2 illustrates a set of proposed tiles.

As shown in FIG. 1, an example of a game board is shown which in this case has five vertical and five horizontal rows comprising twenty-five subdivisions. The number of rows and divisions may be more or less, and need not be equal on each side nor need the subdivisions be square but can be of any shape. This board is made of any suitable material and may even be represented through electronic means. The board may have lettering on its borders to aid the players in properly locating the tiles depending upon a particular version of the game design. FIG. 2 which illustrates a set of tiles shows in row two a category such as occupations; row 3 indicates an example category of house colors, etc. Numeral 4 indicates an example category of sports or recreations; numeral 5 indicates an example category of vehicles or other similar devices; and numeral 6 indicates an example category of pets.

The categories and their elements may be other names, pictures, symbols or distinguishing means, and the number thereof may vary, whereas the shape of the tiles is shown as square, they may obviously be of any configuration as well as three dimensional or figurines.

The term "tiles" is used to denote a means of providing individual elements which are used by participants to develop the game's solution and one or more of the sets of tiles can be utilized in the game operation, one set for each player or groups of players. The sets of tiles can be duplicative but distinguished as different sets so as to indicate player ownership, and such distinguishment may be achieved through color or shape differences or other suitable means.

Figure 3:
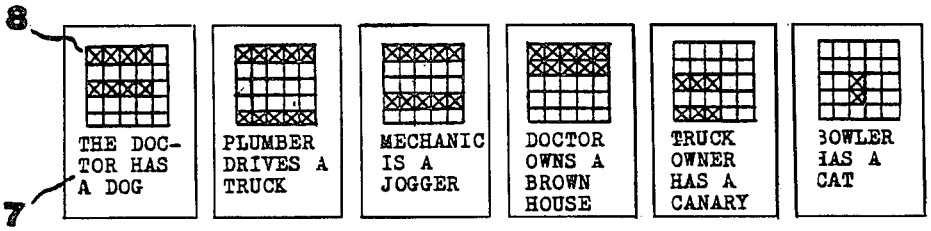
FIG. 3 shows a set of cue cards having representations of the board thereon.
Figure 4:
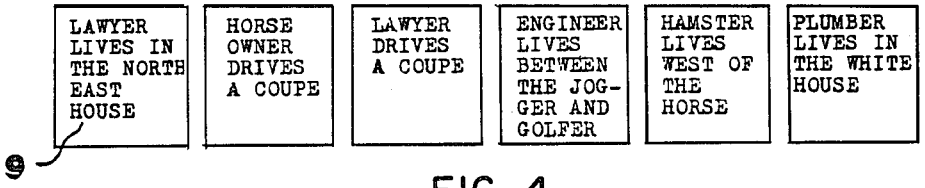
FIG. 4 represents a series of proposed cue cards.
Figure 5:
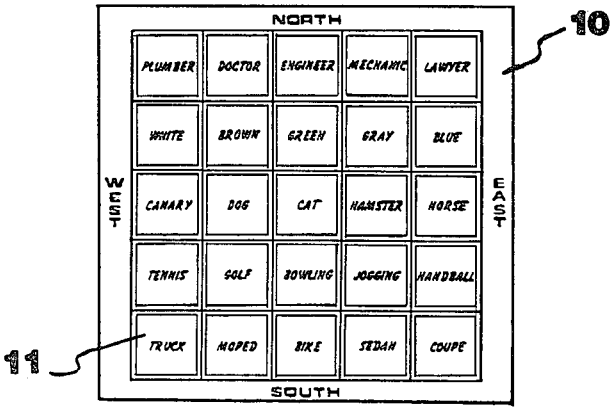
FIG. 5 illustrates a game board filled with tiles forming the solution for a particular deck of cue cards.

Turning now to FIGS. 3 and 4, there is shown for instance at 7, a verbal clue or cue on the card and that is why these cards are referred to as cue cards. These give certain facts involved which must occur in the completed solution shown for instance in FIG. 5 where the board 10 is provided with the tile 11 in correct position thereon but also as shown in FIG. 3 a verbal clue may be combined with a representation of the game board on a card with a notation at 7.

The verbal clues on the cards relate to an element of the category or combination of elements and categories while the X's within the representation of the game board may indicate the board location of the individual elements, a plurality of elements within a category or a total category which contains the element mentioned in the clue. These cards may of course be of any shape and may be provided in lists or in linked cards, upon three dimemsional objects or other suitable media, which allow for the provisions for drawing clues, alternately or randomly, or sequentially.

Figure 6:
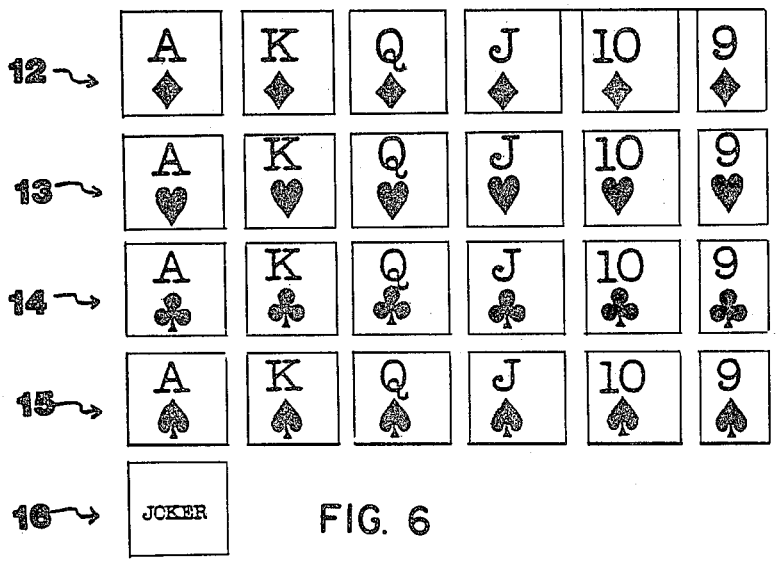
FIG. 6 illustrates an example of a plurality of tiles which may be used in a variation of the game.
Figure 7:
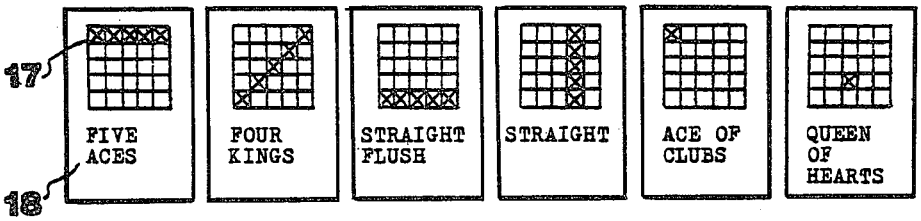
FIG. 7 illustrates an example of a plurality of cue cards corresponding to the tiles illustrated in FIG. 6.
Figure 8:
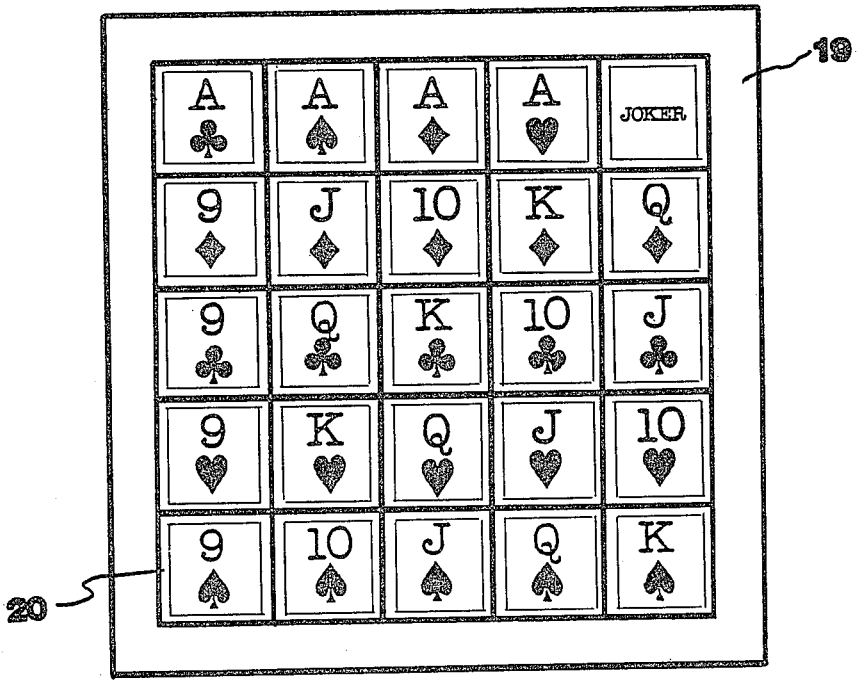
FIG. 8 shows a game board filled with tiles from FIG. 6.

FIGS. 6, 7 and 8 show a variation, it being realized that there is an almost infinite number of variations possible. For instance, the reference numeral 12 indicates certain cards in a deck; the numeral 13 indicates the same thing for different suit and 14 and 15 also indicate the same in different suits with 16 indicating a joker. The reference 17 shows a representation of a cue card and at 18 the cue cards contain the verbal hints which may be used as above described as to FIGS. 3 and 4. FIG. 7 illustrates the correct completed solution.

Figure 9:
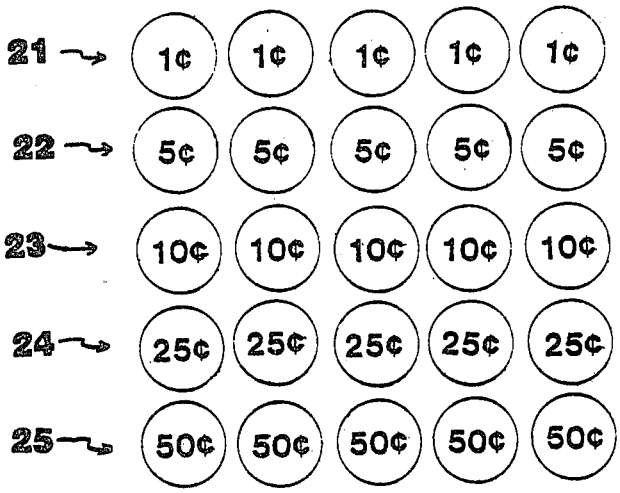
FIG. 9 illustrates an example of a plurality of tiles in another variation.
Figure 10:
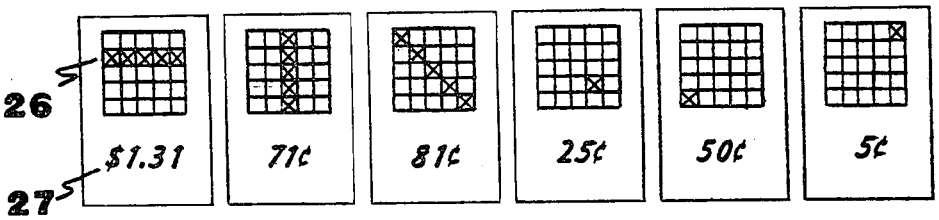
FIG. 10 illustrates the cue cards to go with the example in FIG. 9.
Figure 11:
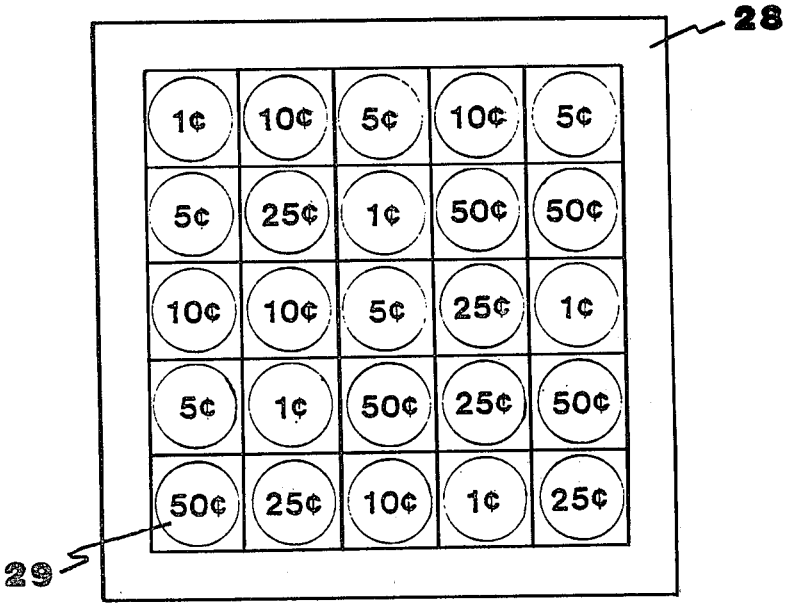
FIG. 11 shows a completed game board filled with tiles from those illustrated in FIG. 9.
Figure 12:
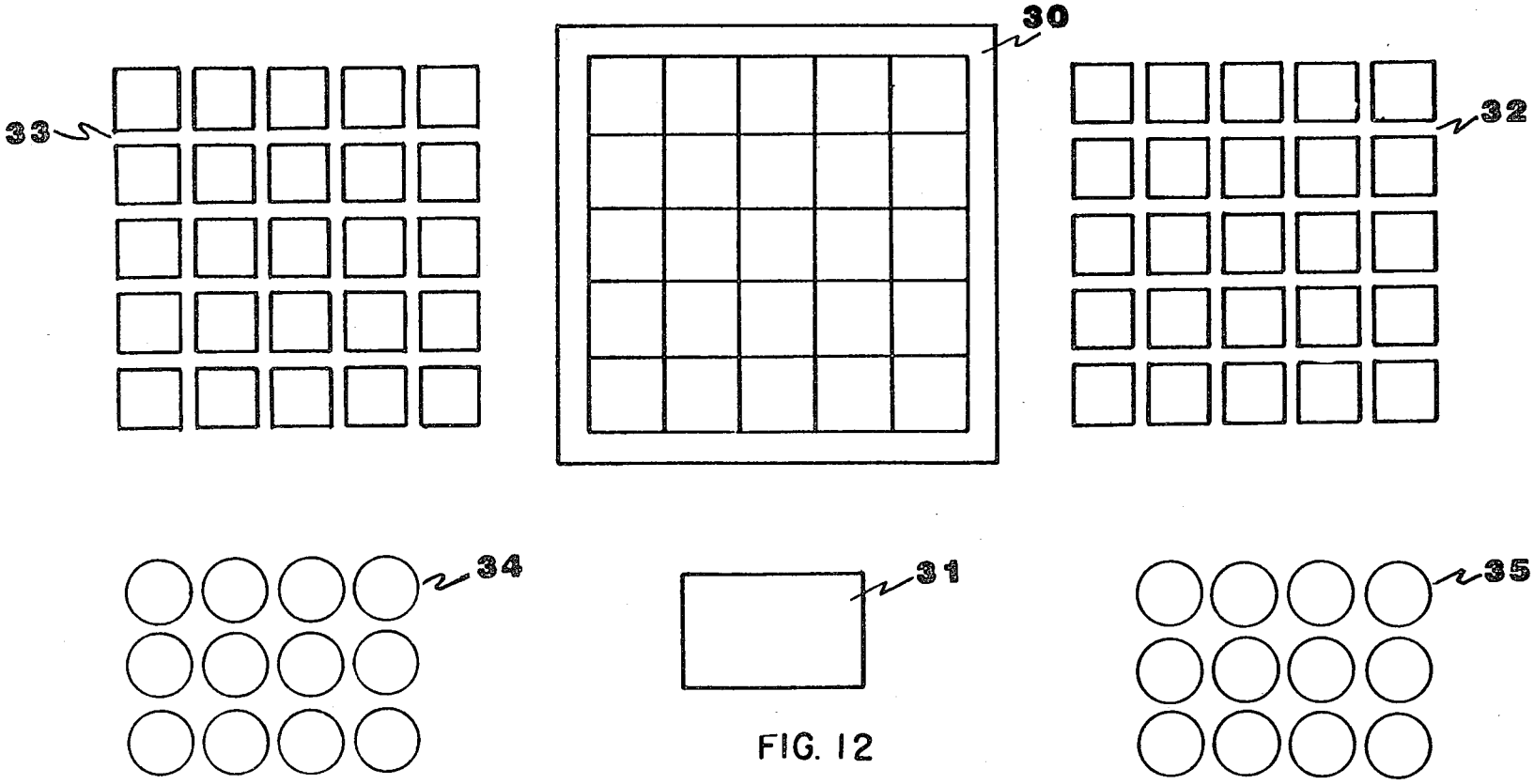
FIG. 12 illustrates an example of game apparatus laid out to play by two players or two groups of players.

FIGS. 9, 10 and 11 show a further modification, but the basis of the game is exactly the same as before, and FIG. 12 brings an example of the game apparatus laid out for play by two players or groups of players. The game board is indicated at 30, the card deck at 31, a set of tiles for one player at 32 whereas 33 indicates a set of tiles for the second player. The representation at 34 indicates a group of chips for a player and 35 indicates the chips for another player. These chips are used to facilitate score keeping and transactions during the operation of the game and they can also be of any size, shape or material for convenient handling.

As an example of the actual playing of the game, it is first decided who will deal for the first round. The players take turns playing dealer in subsequent games. The game tiles are divided so that e.g., one player has twenty-five red tiles and the opposition has twenty-five yellow tiles. The dealer selects a deck of cue cards, shuffles the same and places the deck face down in front of the game board and distributes an equal quantity of chips to himself and opponent. Dealer takes the first turn and opponents alternate turns thereafter.

The one player may or may not decide to buy a cue card. If he decides to do so he takes the top card from the deck which is face down, and places one of his chips next to the cue card deck in the chip pool. He does not of course let his opponent see his cue card, he may or may not decide to sell one of his cue cards. If he decides to sell, he places the card face up so that he and his opponent both see it, then he takes a chip back from the chip pool. The player, however, is obligated to take a tile from his tile bank and place it on the board at each turn, he may also place it on an empty square, on a square which has already one of his own tiles, or a square which contains one of his opponent's tiles.

If a player places a tile on an empty square on the board, no further action is required and it is the next player's turn, but if the player decides to place the tile on a square by one of his own tiles, he must remove the original tile and place it in his tile bank. At the same time, he gives his opponent one of his chips; if he does not have a chip upon this occurrence, his opponent gets five points.

If a player decides to place a tile on a square occupied by one of his opponent's tiles, he removes the existing tile and returns it to his opponent, places his own tile in the now empty square and receives two chips from his opponent. If the opponent cannot supply the two chip penalty, he gets five points. There is a restriction on this in that a player cannot replace one of his opponent's tiles with a tile of identical value.

The game is not over until all twenty-five spaces on the board are filled with tiles in such a way that all cue cards may be read. When a player feels these conditions have been achieved, he may declare the game is over. If his opponent produces a cue card which proves him wrong, he must give his opponent five chips and if he cannot pay, his opponent gets ten points. Scoring may be as follows: total scores are achieved at the end of the game by totalling points earned during the game plus two points each for chips held by players, plus two points each for tiles on the board and scoring is as follows:

| | Payment | Payment Default |
|---|---|---|
| Correct Declaration of Game End | 10 points | |
| Reversal of Declaration | 5 chips | 10 points |
| Replacement of Own Tile | 1 chip | 5 points |
| Replacement of Tile by Opponent | 2 chips | 5 points |
| Each Chip Held at End of Game | 2 points | |
| Each Tile on the Board at End of Game | 2 points | |

I claim:

1. A puzzle game for one or more players comprising:

a planar surface having areas for representing a plurality of positions in adjacent rows;

a set of indicia-bearing elements for disposing at said positions to attempt to achieve a predetermined pattern of said indicia unknown to said player or players;

cue elements for providing a number of independent cues which taken together establish said predetermined pattern, each of said independent cues including a message of a relationship between two or more indicia and an indication of one or more positions in which said indicia may properly be disposed, said indication of one or more positions being a replica of said plurality of positions in adjacent rows with one or more of said positions marked to indicate positions in which said indicia may properly be disposed.

* * * * *